US005983851A

United States Patent [19]

Kimijima et al.

[11] Patent Number: 5,983,851

[45] Date of Patent: Nov. 16, 1999

[54] METHOD FOR LUBRICATING A TWO-CYCLE INTERNAL COMBUSTION ENGINE

[75] Inventors: Takahiro Kimijima; Takaharu Kurosaki, both of Saitama, Japan

[73] Assignee: Honda Giken Kogyo Kabushiki Kaisha, Tokyo, Japan

[21] Appl. No.: 09/080,303

[22] Filed: May 18, 1998

[30] Foreign Application Priority Data

May 23, 1997 [JP] Japan ..... 9-134148

[51] Int. Cl.[6] ..... F01M 1/00

[52] U.S. Cl. ..... 123/196 M

[58] Field of Search ..... 123/73 C, 73 AD, 123/196 R, 196 M

[56] References Cited

U.S. PATENT DOCUMENTS 3,232,379 2/1966 Mueller et al. ..... 184/6.8

5,002,025 3/1991 Crouse ..... 184/6.8

*Primary Examiner*—Noah P. Kamen

[57] ABSTRACT

A method of lubricating a two-cycle internal combustion engine, which is capable of preventing blow-by of an air-fuel mixture in a combustion chamber, is provided for increasing fuel consumption and purifying exhaust gas. Lubrication of a valve portion and a sliding portion of a cylinder bore to a piston is improved so as to enhance maintenance performance and further improve fuel consumption. The method for lubricating a two-cycle internal combustion engine in which a control valve is disposed, in communicating passages for communicating a combustion chamber to a chamber portion adjacent to the combustion chamber, wherein the oil is supplied to bearing portions of the control valve for lubricating the bearing portions, and also the oil permeates through the communicating passages to be supplied to a sliding portion of a cylinder bore to a piston by an injection flow of the fuel or the air-fuel mixture, and lubricates the sliding portion.

5 Claims, 6 Drawing Sheets

METHOD FOR LUBRICATING A TWO-CYCLE INTERNAL COMBUSTION ENGINE

BACKGROUND OF THE INVENTION

1. Technical Field of the Invention

The present invention relates to a method for lubricating a two-cycle internal combustion engine, which is intended to prevent blow-by of an air-fuel mixture in a combustion chamber and hence to enhance fuel consumption and to purify exhaust gases. In particular, the present invention relates to a method for lubricating a two-cycle internal combustion engine of a type in which a control valve is disposed in a communicating passage for communicating a combustion chamber to a chamber portion adjacent to the combustion chamber, for controlling the opening/closing of the communicating passage. A fuel or an air-fuel mixture is injected or charged in the combustion chamber through the communicating passage and a highly compressed gas is injected or charged in the chamber portion through the communicating passage, which is intended to improve lubrication of a bearing portion of the control valve and lubrication of a sliding portion of a cylinder bore to a piston, and hence to enhance the maintenance performance and fuither improve fuel consumption.

2. Description of Background Art

In a related art two-cycle internal combustion engine, fuel supplied from a carburetor or the like is mixed with intake air, and the air-fuel mixture is sucked in a crank chamber and then supplied in a combustion chamber through scavenging openings. In this engine, since the timing of the opening of an exhaust opening is set to be earlier than the timing of the opening of the scavenging openings (an upper edge of the exhaust opening is higher than upper edges of the scavenging openings), there may easily occur exhaust of the air-fuel mixture supplied in the combustion engine into the exhaust opening, that is a so called blow-by of the air-fuel mixture.

The blow-by phenomenon is suppressed by an exhaust-pulsation effect. However, it is difficult to suppress the blow-by over the entire operational range. As a result, the blow-by exerts an adverse effect on fuel consumption and the purity of the exhaust.

Two-cycle internal combustion engines intended to solve such an inconvenience have been disclosed in Japanese Patent Laid-open Nos. Hei 3-1 318 and Hei 5-3 2521.

In the two-cycle internal combustion engine described in Japanese Patent Laid-open No. Hei 3-1 318, a high pressure chamber is connected to a crank chamber through a check valve; the high pressure chamber is connected to a combustion chamber through an air passage; and a solenoid valve is interposed at a lower end of the air passage. A fuel injection valve for injecting fuel in the combustion chamber is provided at an upper end of the air passage.

In the two-cycle internal combustion engine described in Japanese Patent Laid-open No. Hei 5-3 2521, a chamber portion is disposed adjacent to a crank case and a cylinder block. In addition, an intake control valve is interposed between a crank chamber and the chamber portion. A scavenging control valve is interposed between the chamber portion and a combustion chamber in a cylinder; and a fuel injection valve is provided for injecting fuel in the chamber portion.

The two-cycle internal combustion engine described in Japanese Patent Laid-open No. Hei 3-1 318 has a problem. Since the fuel supply opening is provided in a side wall of the cylinder at a position facing to the combustion chamber and, the fuel injection valve is disposed directly perpendicularly to the fuel supply opening, fuel spray collides with the cylinder wall on the exhaust opening side which is opposed to the fuel supply opening and thereby the fuel spray is liable to adhere on the cylinder wall.

When a fuel spraying timing occurs earlier in order to prevent interference between the piston and fuel spray, the fuel spray tends to be blown-by in the exhaust opening. In addition, when the fuel supply opening is disposed at a higher position to delay the fuel spraying timing, the fuel injection valve is directly exposed to a combustion gas at a high temperature, causing an inconvenience in that the injection valve needs a high thermal resistance.

The two-cycle internal combustion engine described in Japanese Patent Laid-open No. Hei 5-3 2521 has a problem. Since the air-fuel mixture injected from the scavenging control valve is supplied in the combustion chamber through all of the scavenging openings, the blow-by of the air-fuel mixture at the exhaust opening cannot be avoided.

To solve the problem of the related art engines, the present inventor has proposed a two-cycle internal combustion engine particularly in Japanese Patent Application No. Hei 8-269366. In the two-cycle internal combustion engine, a control valve is disposed in a communicating passage for communicating a combustion chamber to a chamber portion which is juxtaposed sideward of the combustion chamber and is continuous to a fuel injection device, for controlling opening/closing of the communicating passage, and fuel is injected or charged in the combustion chamber through the communicating passage and a highly compressed gas is injected or charged in the chamber portion through the communicating passage. With this configuration, since scavenging only by air is performed at the beginning of the scavenging step, it is possible to prevent a blow-by phenomenon of the air-fuel mixture in which the air-fuel mixture passes through the combustion chamber and is exhausted into an exhaust passage. Further, since fuel (rich air-fuel mixture) supplied in the combustion chamber becomes an air-fuel mixture at a suitable concentration in the combustion chamber, it is possible to obtain desirable combustion, and hence to achieve a high level fuel consumption and a high exhaust gas purifying performance.

The technique proposed by the present applicant, however, has a problem. Since lubrication of right and left bearing portions of the control valve is performed by enclosing oil in the bearing portions sealed by oil-seals in a state in which the right and left bearing portions are communicated to each other, a periodical maintenance is required to cope with degradation and consumption of the oil.

Further, in the technique proposed by the present inventor, lubrication of a sliding portion of a cylinder bore to a piston is performed by supplying oil from oil supply holes (see oil supply holes 66 in FIG. 5) provided in a cylinder wall surface on the exhaust opening side. However, there occurs a lack of lubrication at the sliding portion of the cylinder bore to the piston on the side of a rich air-fuel mixture supply polt facing to the combustion chamber and a highly compressed gas intake opening. This is because it is difficult to form a lubrication oil film on the sliding portion on the side of the above openings by the cleaning effect of the oil film due to the rich air-fuel mixture and the thermal effect of a compressed gas at a high temperature and a high pressure generated due to the explosion of the ignition.

SUMMARY AND OBJECTS OF THE INVENTION

To solve the above-described problems and to improve the related art method of lubricating a two-cycle internal combustion engine, the present invention has been made to provided a method of lubricating a two-cycle internal combustion engine in which a control valve is disposed, in a communicating passage for communicating a combustion chamber to a chamber portion adjacent to the combustion chamber, for controlling the opening/closing of the communicating passage, and a fuel or an air-fuel mixture is injected or charged in the combustion chamber through the communicating passage and a highly compressed gas is injected or charged in the chamber portion through the communicating passage, wherein the oil is supplied to a bearing portion of the control valve for lubricating the bearing portion, and also the oil permeates through the communicating passage, being supplied to a sliding portion of a cylinder bore to a piston by an injection flow of the fuel or the air-fuel mixture and lubricates the sliding portion.

With the present invention, which is configured as described above, since new oil is usually supplied to the bearing portions of the control valve, it is possible to reduce the need of maintenance. Further, since the oil used for lubricating the bearing portions of the control valve is also supplied to the sliding portion of the cylinder bore to the piston through the communicating passages, it is possible to easily lubricate the bearing portions and the sliding portion.

Since oil is supplied, through the communicating passages and the openings thereof, to the sliding portion of the cylinder bore to the piston on the side of the rich air-fuel mixture supply opening and the highly compressed gas intake opening at which it is difficult to form a lubricating oil film, it is possible to certainly supply oil to the sliding portion of the cylinder bore to the piston on the above side, and hence to form a uniform lubricating oil film thereon.

According to the present invention, since oil can be supplied from the bearing portions of the control valve to the sliding portion of the cylinder bore to the piston on the side of the above openings without the need of any special processing, it is possible to easily supply oil to the sliding portion.

According to the present invention, even when the number of the communicating passages, that is, the number of the openings thereof facing to the combustion chamber is increased and thereby the sliding portion of the cylinder bore to the piston on the side of the openings is extended, it is possible to easily, sufficiently supply oil over the entire range of the sliding portion.

According to the present invention, there is provided a method of lubricating a two-cycle internal combustion engine in which a control valve is disposed, in a communicating passage for communicating a combustion chamber to a chamber portion adjacent to the combustion chamber, for controlling opening/closing the communicating passage, and a fuel or an air-fuel mixture is injected or charged in the combustion chamber through the communicating passage and a highly compressed gas is injected or charged in the chamber portion through the communicating passage wherein the communicating passage is opened to a cylinder bore, and oil is supplied to a sliding portion of the cylinder bore to a piston on the side of the opening portion of the communicating passage, to lubricate the sliding portion.

With the present invention, which is configured as described above, since oil is supplied to the sliding portion of the cylinder bore to the piston on the side of the cylinder hole side openings of the communicating passages, that is, on the side of the rich air-fuel mixture supply opening and the highly compressed gas intake opening at which it is difficult to form a lubricating oil film, it is possible to certainly supply oil to the sliding portion of the cylinder bore to the piston on the side of the above openings, and hence to form a uniform lubricating oil film on the sliding portion of the cylinder bore to the piston on the side of the above openings.

According the present invention, it is possible to directly supply oil to the sliding portion of the cylinder bore to the piston on the side of the cylinder bore side opening of the communicating passage by making effective use of the spaces between the formation position of the communicating passage, that is, the opening thereof and the scavenging passages.

According to the present invention, it is possible to supply oil in the sliding portion of the cylinder bore to the piston on the side of the cylinder bore side openings of the communicating passages, without increasing the number of openings (oil supply openings) opened in the cylinder bore, that is, by making effective use of the scavenging opening formed under the cylinder bore side openings of the communicating passages and the scavenging passage communicated to the scavenging opening.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, a first embodiment of the present invention will be first described with reference to FIGS. 1 and 2.

Figure 1:
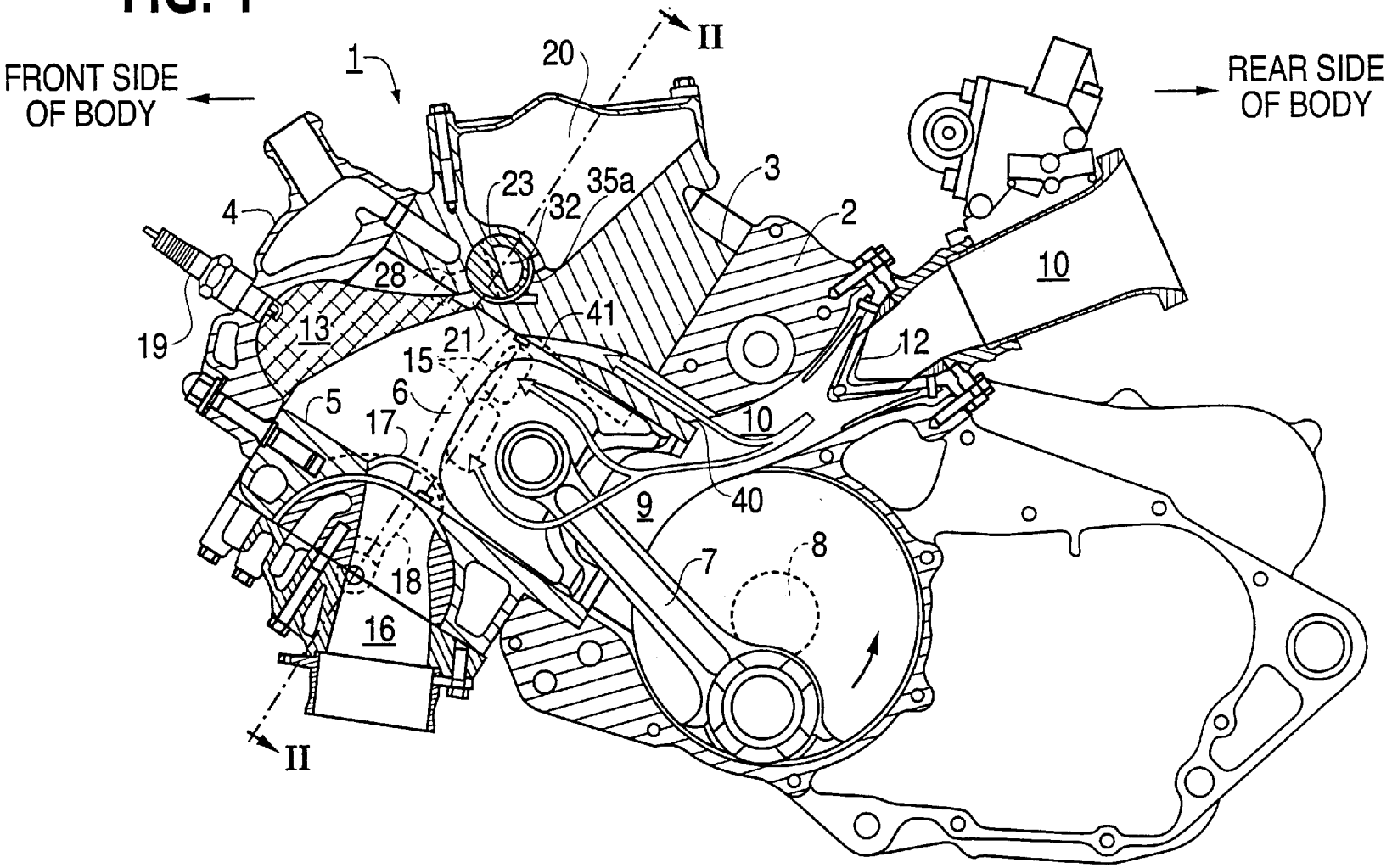
FIG. 1 is a vertical sectional side view of a spark ignition type two-cycle internal combustion engine according to a first embodiment of the present invention.
Figure 2:
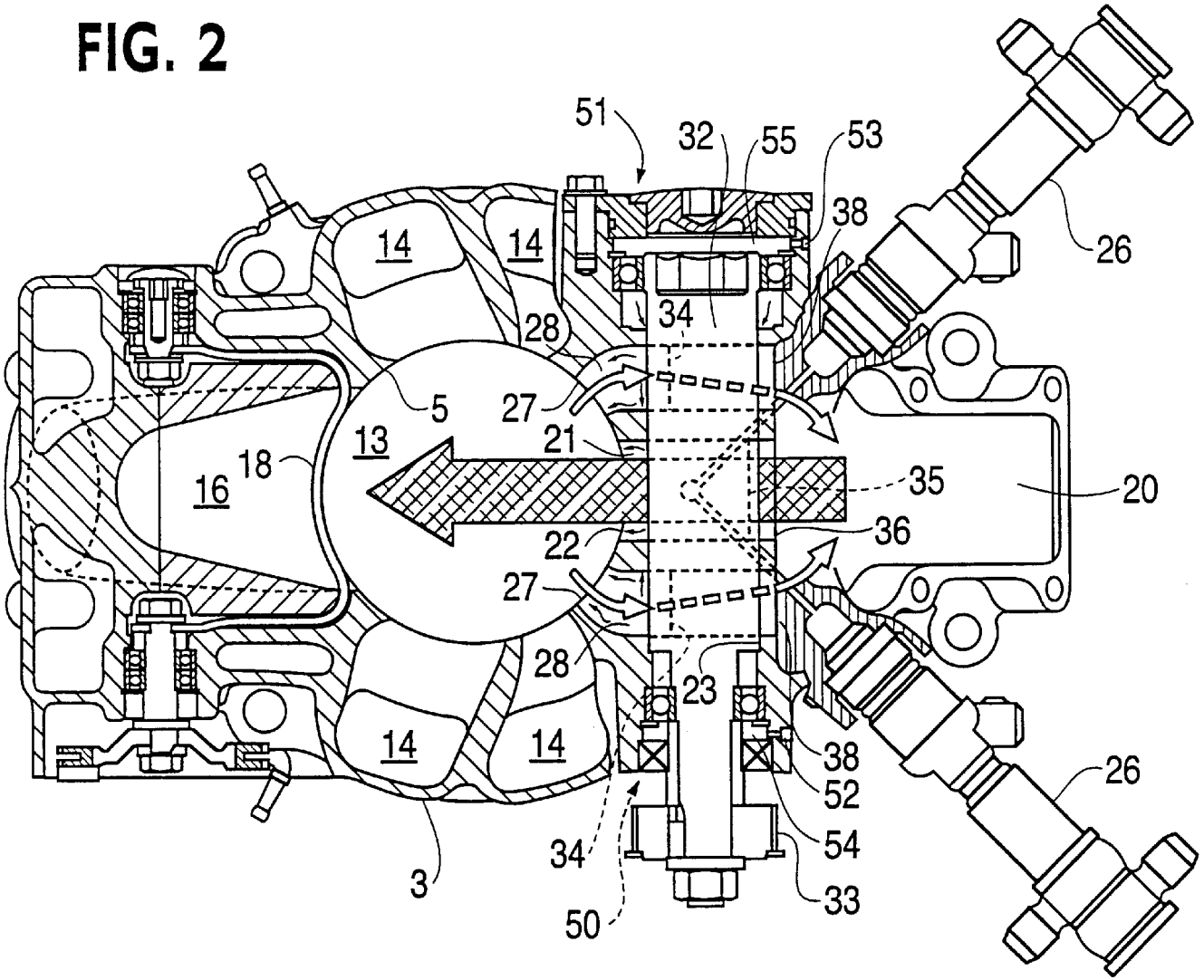
FIG. 2 is a transverse sectional side view taken on along line II-II of FIG. 1.

Referring to FIGS. 1 and 2 a spark ignition type two-cycle internal combustion engine 1 is mounted on a motorcycle (not shown). In this engine 1, a cylinder block 3 and a cylinder head 4 are sequentially superimposed on the crank case 2 and integrated to each other.

A piston 6 is vertically slidably inserted in a cylinder bore 5 formed in the cylinder block 3. The piston 6 is connected to a crank shaft 8 by means of a connecting rod 7, so that the crank shaft 8 is rotated by vertical movement of the piston 6.

An intake passage 10 extending forward from a rear side of a vehicular body is connected to the crank case 2. A throttle valve (not shown) and a reed valve 12 are interposed in series in the intake passage 10. The throttle valve is connected to a throttle grip (not shown) through a connecting means in such a manner that the degree of opening of the throttle valve is increased when the throttle grip is twisted in one direction.

Air supply scavenging passages having five pieces in total, four pieces (two pieces disposed on each of right and left sides) of air supply scavenging passages 14 and a rear side air supply scavenging passage 40, are formed in the crank case 2 and the cylinder block 3. The passages 14 are provided for communicating an upper portion of the cylinder bore 5 to the crank case 2. The passage 40 is opened under an air-fuel mixture supply opening (fuel supply opening) 22 and highly compressed gas intake openings 27 (these opening 22 and 27 will be described later). Ends of these scavenging passages 14 and 40 on the cylinder bore 5 side from openings 15 and 41 opened to the cylinder bore 5, respectively. The air supply scavenging passage 40 is directly connected to the intake passage 10 in the crank case 2 on the downstream side of the reed valve 12.

An exhaust opening 17, of an exhaust passage 16 on the cylinder bore 5 side extends higher than the openings 15 and 41 of the air supply scavenging passages 14 and 40, and is disposed at a position opposed to the air-fuel mixture supply opening (fuel supply opening) 22 and the highly compressed gas intake opening 27 (which will be described later). An exhaust control valve 18 is provided near an upper edge of the exhaust opening 17 of the exhaust passage 16, for varying an exhaust cross-section and an exhaust timing.

A combustion chamber 13 is formed in an approximately semispherical shape, which is disposed over the cylinder bore 5, and is offset towards the exhaust opening 17. An ignition plug 19 is disposed adjacent to the combustion chamber 13.

A chamber portion 20 is juxtaposed to the cylinder block 3 disposed sideward of the combustion chamber 13 in such a manner as to be offset towards the rear side of the body. A valve containing hole 23 is disposed halfway of first and second communicating passages 28 and 21 for communicating the chamber portion 20 to the combustion chamber 13 (upper portion of the cylinder bore 5), and a rotary valve (control valve) 32 is rotatably inserted in the valve containing hole 23. The rotary valve 32 is rotated at the same rotational speed in the direction reversed to the rotational direction of the crank shaft 8 (clockwise in FIG. 1) by a transmission mechanism (not shown). A pulley 33 is mounted at one end of the rotary valve 32. The above transmission mechanism (not shown) is mounted around the pulley 33.

A highly compressed gas is allowed to flow from the combustion chamber 13 into the chamber portion 20 through the first communicating passages 28. An air-fuel mixture or a highly compressed gas in a state before forming the air-fuel mixture is allowed to flow from the chamber portion 20 into the combustion chamber 13 through the second communicating passage 21. The flow of the highly compressed gas and the air-fuel mixture in both the communicating passages 28 and 21 are adjusted by controlling opening/closing of first and second control valves 34 and 35 at specific timings. The first control valves 34 are part of the rotary valve 32 and are disposed in the first communicating passages 28. The second control valve (air-fuel mixture injection control valve) 35 is part of the rotary valve 32 and is disposed in the second communicating passage 21.

As shown in FIG. 2, the first communicating passages 28 are provided at two positions on right and left sides. A first control valve 34 is provided in each of the first communicating passages 28. A second communicating passage 21 is disposed between both of the first communicating passages 28.

An air-fuel mixture is formed as follows:

As shown in FIG. 2, two pieces of fuel injection devices 26 are mounted on the cylinder block 3 in such a manner as to be symmetric on the right and left sides of the chamber portion 20. Before the second control valve 35 opens the second communicating passage 21, fuel is injected obliquely downwardly from the right and left fuel injection devices 26 into an air-fuel mixture forming space (formed halfway of the second communicating passage 21 as part thereof) to which a peripheral cutout 35*a* of the second control valve 35 faces. The fuel is injected at an approximately central portion of the second communicating passage 21 in a plan view (see FIG. 2). In such a state, the chamber portion 20 is connected to the fuel injection devices 26 through an opening 36 of the second communicating passage 21 on the chamber portion 20 side and the air-fuel mixture forming space.

Next, when the second, control valve 35 opens the second communicating passage 21, a highly compressed gas charged in the chamber portion 20 is allowed to flow from the opening 36 of the second communicating passage 21 on the chamber portion 20 side into the second communicating passage 21. The highly compressed gas is thus mixed with the fuel present in the second communicating passage 21 to form an air-fuel mixture. The air-fuel mixture is then press-fed by a high pressure in the chamber portion 20, to be thus injected from the air-fuel mixture supply opening 22 into the combustion chamber 13.

Bearing portions of the rotary valve (control valve) 32, and a sliding portion of the cylinder bore 5 to the piston 6 on the side of the cylinder bore 5 side openings 22 and 27 of the communicating passages 21 and 28 are lubricated as follows:

Oil supply holes 52 and 53 are formed in a wall surface of thecontaining hole 23 for containing the rotary valve 32. Right and left bearing portions 50 and 51 of the rotary valve 32 are lubricated by supplying oil from an oil pump (not shown) through the oil supply holes 52 and 53 into internal spaces 54 and 55 of the bearing portions 50 and 51.

The oil flowing in the internal spaces 54 and 55 lubricates ball bearings disposed therein, and is allowed to flow towards a central portion in the axial direction of the rotary valve 32 through a gap between an outer peripheral surface of the rotary valve 32 and an inner wall surface of the containing hole 23. Then, the oil permeates in the communicating passages 21 and 28, being transmitted along wall surfaces of the communicating passages 21 and 28, and flows into the cylinder bore 5 from the air-fuel mixture supply opening 22 and the highly compressed gas intake openings 27.

In the cylinder bore 5, the oil is stirred by reciprocating motion of the piston 6 to be extended over the entire range of the sliding portion of the cylinder bore 5 to the piston 6 on the side of the openings 22 and 27, thus lubricating the sliding portion.

Figure 3:
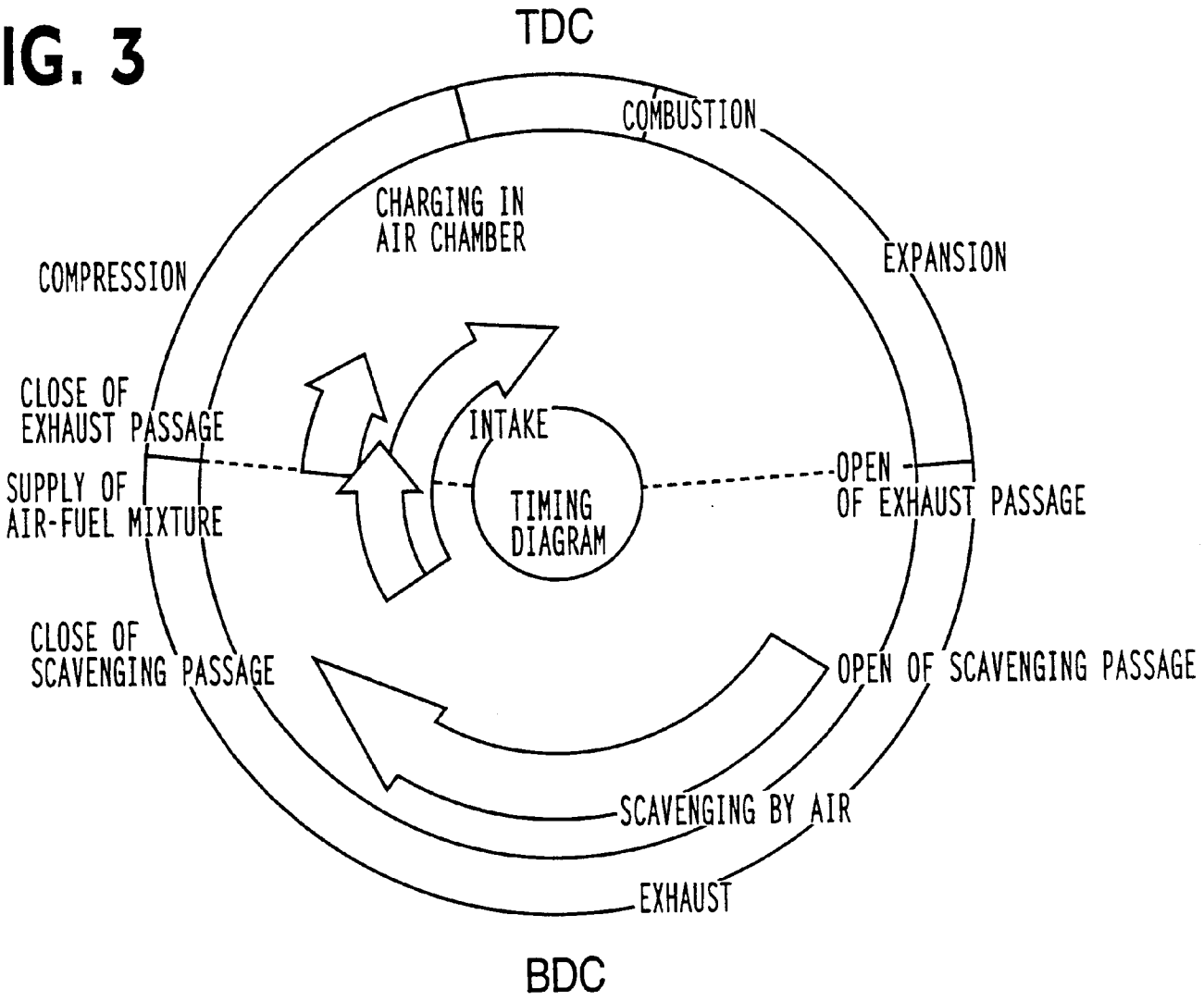
FIG. 3 is a diagram illustrating an operational cycle of the spark ignition type two-cycle internal combustion engine of the embodiment shown in FIG. 1.

The spark ignition type two-cycle internal combustion engine 1, shown in the figures, having the above configuration is operated as follows:

When the crank shaft 8 is rotated counterclockwise in FIG. 1 by a starter motor (not shown), as shown in FIG. 3, the exhaust opening 17 is blocked by the piston 6 at a point of 90° before a top dead, center (TDC) (compression stroke). At this time, the first control valves 34 open the first communicating passages 28, so that a highly compressed gas in the combustion chamber 13 flows into the chamber portion 20 through the highly compressed gas intake openings 27, the first communicating passages 28, and openings 38 to charge the chamber portion 20 with the highly compressed gas.

Then, at a point of 75° before the top dead center (TDC), the air-fuel mixture supply opening 22 of the second communicating passage 21 at its end portion on the combustion chamber 13 side is blocked with the piston 6, and thereafter, the highly compressed gas intake openings 27 are blocked with the piston 6. Thus, supply of the air-fuel mixture into the combustion chamber 13 and charging of the highly compressed gas into the chamber portion 2 are sequentially completed.

The interior of the combustion chamber 13 is further compressed, and at a point before the top dead center (TDC), the ignition plug 19 is ignited. The crank chamber 9 is continuously expanded by upward movement of the piston 6, to thus continue the intake operation.

After the piston 6 reaches the top dead center (TDC), the air-fuel mixture in the combustion chamber 13 is burned and the interior of the combustion chamber 13 is expanded. Then, the crank chamber 9 is compressed by downward movement of the piston 6 to compress air in the crank chamber 9.

At a point of 90° after the top dead center (TDC), (which varies depending on the vertical position of the exhaust control valve 18), the exhaust opening 17 is opened to exhaust a combustion gas from the exhaust passage 16.

Further, at a point of about 122° after the top dead center (TDC), the scavenging openings 15 and 41 are opened by downward movement of the piston 6. As a result, the air (not containing fuel) compressed in the crank chamber 9 flows from the scavenging openings 15 and 41 into the combustion chamber 13 through the air supply scavenging passages 14 and 40 to push the burnt gas in the combustion chamber 13 towards the exhaust opening 17. Thus, scavenging only by the air is performed. At the same time, fuel is injected from the fuel injection devices 26 into the air-fuel mixture foiming space to which the cutout 35*a* of the second control valve 35 faces.

Next, at a point of about 58° after a bottom dead center (BDC), the scavenging openings 15 and 41 are blocked by upward movement of the piston 6, and the scavenging due to flow-in of the air from the scavenging openings 15 and 41 is stopped. Substantially from this point, the second control valve 35 opens the second communicating passage 21, and the air-fuel mixture is injected from the air-fuel mixture supply opening 22 into the combustion chamber 13 to scavenge the remaining burnt gas. At the same time, air is sucked in the crank chamber 9 from the intake passage 1 through the reed valve 12 by expansion of the interior of the crank chamber 9 by upward movement of the piston 6. In addition, upon scavenging of the remaining burnt gas, there little occurs blow-by of the air-fuel mixture.

The spark ignition type two-cycle internal combustion engine 1 in this embodiment, which is so configured as described above, has the following effects.

In the spark ignition type two-cycle internal combustion engine 1, since scavenging only by air is performed at the beginning of the scavenging step, it is possible to prevent a blow-by phenomenon in which an air-fuel mixture passes through the interior of the combustion chamber 13 and is exhausted in the exhaust passage 16, and hence to improve fuel consumption and prevent air pollution due to unburnt gas.

Since an air-fuel mixture produced by mixing air charged in the chamber portion 20 with fuel injected from the fuel injection devices 26 in the second communicating passage 21 is rich and the rich air-fuel mixture flows in the combustion chamber 13 which has been sufficiently scavenged by air (not containing fuel) having passed through the air supply scavenging passages 14, the rich air-fuel mixture becomes an air-fuel mixture at a suitable concentration in the combustion chamber 13. The air-fuel mixture thus adjusted in the combustion chamber 13 allows desired combustion, thus attaining a high level fuel consumption and a high exhaust, as purifying performance.

Since new oil is usually supplied to the bearing portions 5 and 51 of the rotary valve (control valve ) 32, it is possible to reduce the need for maintenance. Further, since the oil used for lubricating the bearing portions 5 and 51 of the rotary valve 32 is also supplied from the bearing portions 5 and 51 to the sliding portion of the cylinder bore 5 to the pistons through the communicating passages 21 and 28, it is possible to easily lubricating the bearing portions 5 and 51 and the sliding portion.

Since oil is supplied, through the communicating passages 21 and 28 and the openings 22 and 27 thereof, to the sliding portion of the cylinder bore 5 to the piston 6 on the side of the rich air-fuel mixture supply opening 22 and the highly compressed gas intake openings 27 at which it is difficult to form a lubricating oil film, it is possible to supply oil to the sliding portion of the cylinder bore 5 to the piston 6 on the above side, and hence to form a uniform lubricating oil film thereon.

Since oil can be supplied from the bearing portions 5 and 51 of the rotary valve 32 to the sliding portion of the cylinder bore 5 to the piston 6 on the side of the openings 22 and 27 with a simple structure in which only the short oil supply holes 52 and 53 are formed in the wall surface of the containing hole 32 without any special processing, it is possible to easily supply oil to the sliding portion.

Further, since the second communicating passage 21 and the two first communicating passages 28, that is, the opening 22 and the two openings 27 thereof extend in the axial direction of the rotary valve 32 in the transverse sectional side view (see FIG. 2), the sliding portion of the cylinder bore 5 to the piston 6 on the side where these opening is 22 and 27 are present is extended. In this case, however, by supplying oil to the sliding portion of the cylinder bore 5 to the piston 6 through the communicating passages 21 and 28 as described above, the oil can be sufficiently supplied up to a central portion of the sliding portion. As a result, it is possible to easily, sufficiently supply the oil over the entire range of the sliding portion.

Next, a second embodiment of the present invention will be described with reference to FIGS. 4 and 5.

In this embodiment, a communicating passage 60 for communicating a combustion chamber 13 to a chamber portion 20 is taken as a common communicating passage through which a highly compressed gas flows from the combustion chamber 13 into the chamber portion 20 and an air-fuel mixture or a highly compressed gas flows from the chamber portion 20 into the combustion chamber 13. The communicating passage 60 is composed of a communicating passage 60*a* on the combustion chamber 13 side with a control portion of a rotary valve 61 positioned therebetween; communicating passages 60*b* each extending obliquely upward on the chamber- portion 20 side; and communicating passages 60*c* each being bent at right angle from an intermediate portion of the communicating passage 60*b* and extending obliquely upwardly therefrom. An end portion of each communicating passage 60*c* is connected to the chamber portion 20 through an opening 62.

Figure 5:
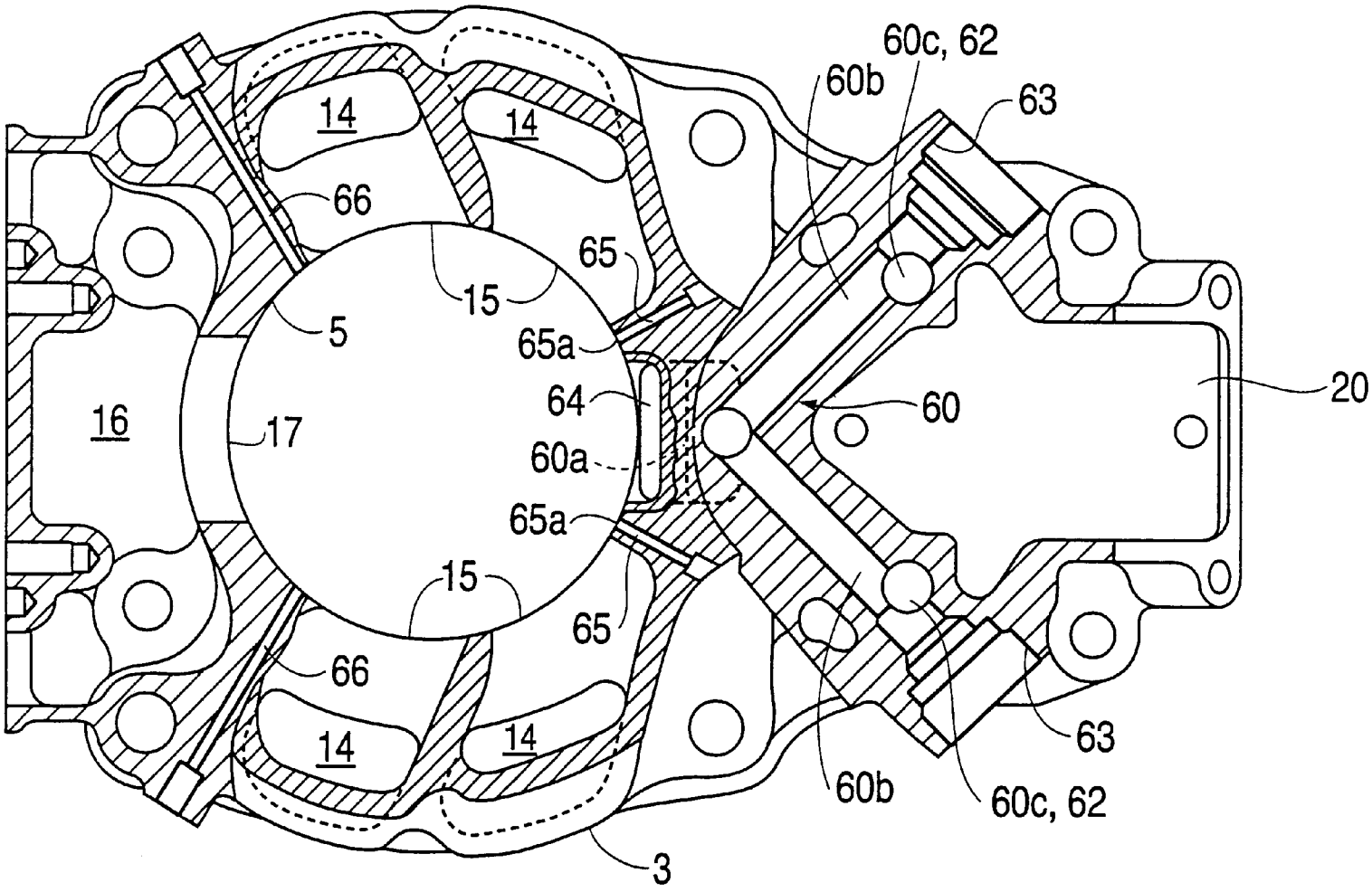
FIG. 5 is a transverse sectional side view taken on along line V-V of FIG. 4 showing only an air-fuel mixture supply opening portion serving as a highly compressed gas intake opening portion which is cutout along a different plane.

As shown in FIG. 5, two sets of the communicating passage systems each being composed of the communicating passage 60*b*, communicating passage 60*c* and the opening 62 on the chamber portion 20 side are symmetrically disposed right and left with the chamber portion 20 positioned therebetween. A fuel injection device (not shown) is mounted in each of mounting holes 63 at end portions of the communicating passages 60*b*.

The rotary valve (control valve) 61 disposed in the communicating passage 60 includes a first control valve 61*a* formed of a deeper cutout and a second control valve 61*b* formed of a shallower cutout. The second control valve 61*b* is provided continuously to the first control valve 61*a* on the front side of the first control valve 61*a* in the rotational direction. The second control valve 61*b* controls a flow of an air-fuel mixture and the first control valve 61*a* controls a flow of a highly compressed gas.

In addition, an air-fuel mixture supply opening (fuel supply opening) 64 serving as a highly compressed gas intake opening, which communicates the communicating passage 60 to the combustion chamber 13, has a longer vertical length for making easy intake of a sufficient amount of a highly compressed gas into the chamber portion 20 and for enhancing atomization of fuel. That is, the cross-section of the opening 64 is very large as compared to that of the midway of the communicating passage 60 and is largely extending towards the combustion chamber 13 (see FIG. 4).

The rotary valve 61 in this embodiment is operated substantially in accordance with the same manner as that in the first embodiment to control the flow of an air-fuel mixture and the flow of a highly compressed gas. Here, switching from the flow of an air-fuel mixture to the flow of a highly compressed gas is dependent on a balance between a pressure in the combustion chamber 13 and a pressure in the chamber portion 20 because the communicating passage 60 is taken as the common communicating passage. To be more specific, when the pressure in the chamber portion 20 is more than the pressure in the combustion chamber 13, the flow of gas in the communicating passage 60 is switched from the flow of an air-fuel mixture to the flow of a highly compressed gas.

Substantially at this time, the control of the flow of an air-fuel mixture by the second control valve 61*b* is shifted to control of the flow of a highly compressed gas by the first control valve 61*a*.

The operation of the spark ignition type two-cycle internal combustion engine in this embodiment is substantially the same as that in the first embodiment, except for the above-described operation of the rotary valve 61, and therefore, the detailed explanation thereof is omitted.

In this embodiment, a sliding portion of a cylinder bore 5 to a piston 6 on the side of the air-fuel mixture supply opening (fuel supply opening) 64 serving as the highly compressed gas intake opening, which is the opening of the communicating passage 60 on the cylinder bore 5 side, is lubricated as follows:

Oil supply holes 65 are formed in a wall of the cylinder bore 5 at positions between the cylinder bore 5 side opening 64 of the communicating passage 60 and scavenging passages 14, that is, openings 15 thereof on right and left sides of the cylinder bore 5 side opening 64 of the communicating passage 60. Oil supplied from an oil pump (not shown) through openings 65*a* of the oil supply holes 65 flows in the cylinder bore 5, and is stirred by reciprocating motion of the piston 6, to be extended over the entire range of the sliding position of the cylinder bore 5 to the piston 6 on the opening 64 side, thus lubricating the sliding portion. In addition, like the related at manner, oil is supplied from oil supply holes 66 provided on a wall surface of a cylinder on an exhaust opening 17 side.

In this embodiment having the above configuration, it is possible to supply oil to the sliding portion of the cylinder bore 5 to the piston 6 on the opening 64 side by making effective use of the spaces between the formation position of the communicating passage 60, that is, the opening 64 thereof and the scavenging passages 14, that is, the openings 15 thereof, and hence to easily form a uniform lubricating oil film on the sliding portion which is difficult to form with the lubricating oil film.

In this embodiment, since only one communicating passage 60 is taken as the common communicating passage through which injection of an air-fuel mixture into the combustion chamber 13 and charging of a highly compressed gas into the chamber portion 20 are commonly performed, a peripheral width of the communicating passage 60 is relatively short. As a result, it is possible to sufficiently supply oil up to a central portion of the sliding portion, and hence to achieve the desirable lubrication of the sliding portion.

In addition to the above-described effect, an effect similar to that in the first embodiment can be obtained.

Figure 6:
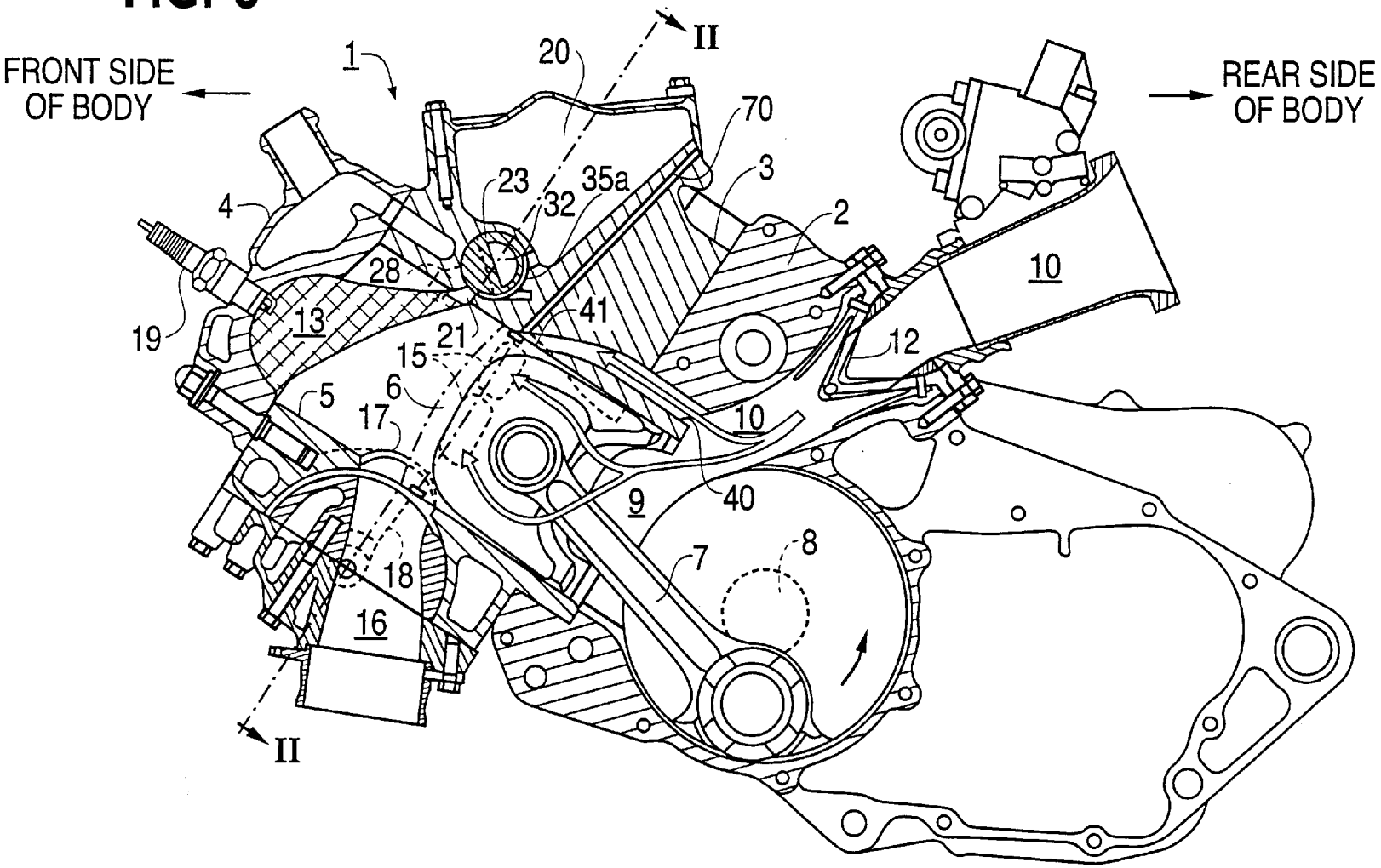
FIG. 6 is a vertical sectional side view, similar to FIG. 1, showing a spark ignition type two-cycle internal combustion engine according to a third embodiment of the present invention.

Next, a third embodiment of the present invention will be described with reference to FIGS. 6 and 2.

In this embodiment, the present invention is applied to a spark ignition type two-cycle internal combustion engine 1 which is of the same type shown in the first embodiment. FIG. 6 is a vertical sectional side view, similar to FIG. 1, showing the engine 1. The transverse sectional side view taken on line II-II of FIG. 6 is the same as that shown in FIG. 2, except for the structure for lubricating bearing portions of a rotary valve (control valve) 32, and the structure for lubricating a sliding portion of a cylinder bore 5 to a piston 6 on the side of cylinder bore 5 side openings of communicating passages 21 and 28.

In this embodiment, the sliding portion of the cylinder bore 5 to the piston 6 on the side of the cylinder bore 5 side openings 22 and 27 of the communicating passages 21 and 28 is lubricated as follows:

An oil supply hole 70 for supplying oil supplied from an oil pump (not shown) into a scavenging passage 40 near a scavenging opening 41 is formed in a cylinder block 3 under a chamber portion 20. Oil supplied through the oil supply hole 70 flows into the scavenging passage 40 from an opening of the oil supply hole 70 facing to the scavenging passage 40 near the scavenging opening 41, which is carried by scavenging air, and flows into a cylinder from the scavenging opening 41.

Since the scavenging opening 41 is formed under the cylinder bore 5 side openings 22 and 27 of the communicating passages 21 and 28, oil flowing in the cylinder through the scavenging opening 41 is stilted by reciprocating motion of the piston 6, to be extended over the range of a sliding portion of the cylinder bore 5 to the piston 6 on the side where the openings 22, 27 and 41 are formed, thus lubricating the sliding portion.

In this embodiment having the above configuration, it is possible to supply oil in the sliding portion of the cylinder bore 5 to the piston 6 on the side of the cylinder bore 5 side openings 22 and 27 of the communicating passages 21 and 28, without increasing the number of openings (oil supply openings) opened in the cylinder bore 5, that is, by making effective use of the scavenging opening 41 formed under the cylinder bore 5 side openings 22 and 27 of the communicating passages 21 and 28 and the scavenging passage 40 in communication with the scavenging opening 41.

Accordingly, it is possible to easily lubricate the sliding portion and also sufficiently supply oil to the sliding portion by suitably selecting the number and the positions of the oil supply holes 70, and hence to achieve a desirable lubrication of the sliding portion.

Figure 4:
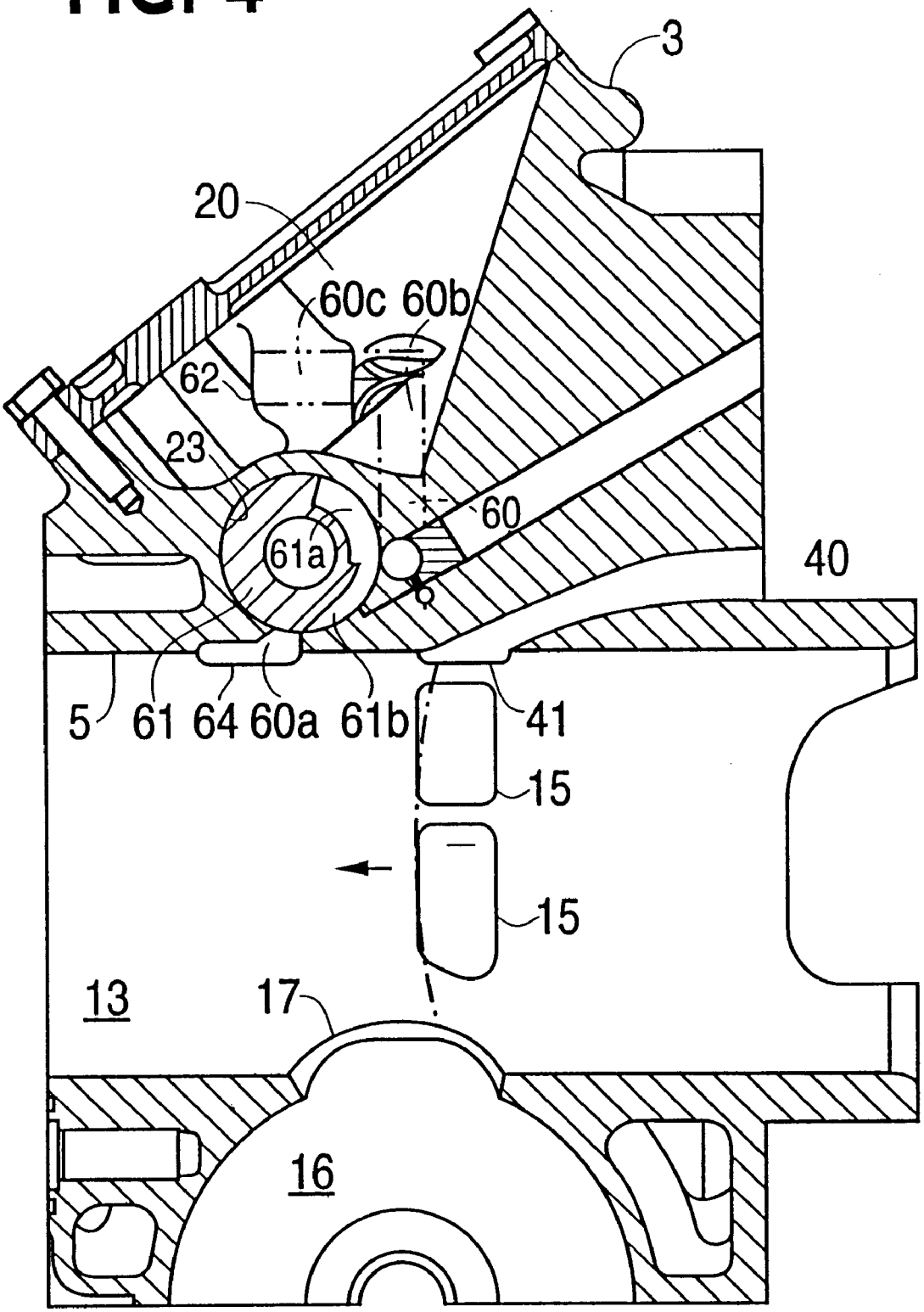
FIG. 4 is an enlarged vertical sectional side view showing an essential portion of a spark ignition type two-cycle internal combustion engine according to a second embodiment of the present invention.

In addition, the lubricating method in this embodiment can be suitably applied to the spark ignition type two-cycle internal combustion engine in which the communicating passage for communicating the combustion engine 13 to the chamber portion 20 is taken as the common communicating passage through which the flow of an air-fuel mixture and the flow of a highly compressed gas are injected as shown in FIGS. 4 and 5.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for lubricating a two-cycle internal combustion engine having a control valve disposed in a communicating passage for communicating a combustion chamber to a chamber portion adjacent to the combustion chamber, for controlling opening/closing of the communicating passage, and at least one of a fuel and an air-fuel mixture is injected or charged into the combustion chamber through the communicating passage and a highly compressed gas is injected or charged in the chamber portion through the communicating passage comprising the following steps:

supplying oil to a bearing portion of the control valve for lubricating the bearing portion;

permeating the oil through the communicating passage;

supplying the oil to a sliding portion of a cylinder bore to a piston by an injection flow of the fuel or the air-fuel mixture; and lubricating the sliding portion.

2. The method for lubricating a two-cycle internal combustion engine according to claim 1, wherein the control valve comprises a rotary valve, and the oil permeates in the communicating passage through a gap between the rotary valve and a hole containing the rotary valve.

3. The method for lubricating a two-cycle internal combustion engine according to claim 2, wherein the communicating passage comprises a first communicating passage through which a highly compressed gas flows from the combustion chamber into the chamber portion, and a second communicating passage through which an air-fuel mixture flows from the chamber portion into the combustion chamber; and the control valve comprises a first control valve and a second control valve for controlling the first communicating passage and the second communicating passage, respectively.

4. The method for lubricating a two-cycle internal combustion engine according to claim 1, wherein the communicating passage comprises a first communicating passage through which a highly compressed gas flows from the combustion chamber into the chamber portion, and a second communicating passage through which an air-fuel mixture flows from the chamber portion into the combustion chamber; and the control valve comprises a first control valve and a second control valve for controlling the first communicating passage and the second communicating passage, respectively.

5. A method for lubricating a two-cycle internal combustion engine, said method comprising:

providing a cylinder bore and a piston reciprocally movable in the cylinder bore;

providing a combustion chamber at an end of the cylinder bore, a chamber portion adjacent to the combustion chamber, and a communicating passage communicating the chamber portion to an opening portion in the cylinder bore;

providing a control valve in the communicating passage, the control valve controlling opening and closing of the communicating passage;

injecting at least one of a fuel and an air-fuel mixture into the combustion chamber through the communicating passage;

injecting a highly compressed gas into the chamber portion through the communicating passage; and supplying oil, via an oil supply passage, to a first portion of the cylinder bore, against which the piston slides, wherein the first portion of the cylinder bore is located on the same side of the cylinder bore as the opening portion of the communicating passage, wherein the oil supply passage is connected to oil support ports provided on right and left sides of the opening portion of the communicating passage, and wherein a scavenging opening is provided under the opening portion of the communicating passage, a scavenging passage is communicated with the scavenging opening, and the oil supply passage is communicated to the scavenging passage and supplies oil to the first portion of the cylinder bore via the scavenging opening.

* * * * *